United States Patent [19]

Pierrel et al.

[11] 4,353,531

[45] Oct. 12, 1982

[54] PROCESS AND INSTALLATION FOR THE HANDLING AND HEAT TREATMENT OF CAST IRON OR STEEL PIPES AND TUBES

[75] Inventors: Michel Pierrel, Pont A Mousson; Guy Mertzweiller, Blenod les Pont a Mousson, both of France

[73] Assignee: Pont-A-Mousson S.A., Nancy, France

[21] Appl. No.: 172,038

[22] Filed: Jul. 24, 1980

[30] Foreign Application Priority Data

Aug. 3, 1979 [FR] France ..... 79 19940

[51] Int. Cl.[3] ..... C21D 1/46

[52] U.S. Cl. ..... 266/120; 266/130; 266/132; 266/133; 266/249

[58] Field of Search ..... 266/117, 119, 120, 121, 266/122, 127, 130, 131, 132, 133, 249, 277

[56] References Cited

U.S. PATENT DOCUMENTS 2,832,700 4/1958 Balestra ..... 266/120

4,177,088 12/1979 Pierrel ..... 266/132

*Primary Examiner*—John P. Sheehan

*Attorney, Agent, or Firm*—Sughrue, Mion, Zinn, Macpeak & Seas

[57] ABSTRACT

Concave rails 17, upon which a pipe which is to be treated by at least partial immersion can be placed, are fixed in the bottom of a furnace 1 which contains a treatment bath M. In order to guarantee that the pipe is immersed over the whole of its cross section and in order to eliminate the risk of it becoming oval, the furnace is subjected to alternating rotation about its axis XX, which compels the pipe to turn on itself by rolling on the rails 17. The handling of the pipe is achieved by arms 12 which are assembled in a pivoting manner on the external wall of the furnace and controlled by an actuator 15.

12 Claims, 14 Drawing Figures

XX
YY
M
T
G
G1
D1
C
C1
f
f1
P
1
3
4
6
7
11
12
17
18
21
22
24

PROCESS AND INSTALLATION FOR THE HANDLING AND HEAT TREATMENT OF CAST IRON OR STEEL PIPES AND TUBES

The present invention is concerned with the heat treatment of spheroidal or lamellar graphite cast iron pipes, which are moulded by centrifuging, and of steel tubes, and more precisely to the annealing of such products in a metal bath of for example aluminum or an aluminium alloy.

The applicant has described a process and an installation for carrying out such a heat treatment in the French patent application filed on Mar. 2nd 1977 under the number 77/06076, which is now published under the number 2,382,502.

The process which is known from the above patent application consists of causing a cast iron pipe which is immersed, partially or totally, in a metal bath, to rotate in such a manner that in all cases its entire cross section is introduced into the bath during the course of rotation. This avoids ovalisation of the pipe.

According to application 77/06076, an installation for implementing this process consists of arms for suspending the pipe in a horizontal position in the metal bath. These arms, which are equipped with carrying rollers which are positioned within the pipe but outside the bath, are assembled on hoists and are retractable when the pipe is suspended from a lifting beam above the treatment bath.

The aim of the present invention, which also implements the process recalled above of the patent application 77/06076, is a process and an installation for handling and treatment of cast iron or steel pipes or tubes, which introduce a notable simplification to the handling of the pipes in order to put them into the bath and remove them from the bath, as well as for supporting them within the metal bath.

The present invention provides a process for the heat treatment of a cast iron or steel pipe or tube, in which the pipe is immersed at least partially in a metal bath contained in a cylindrical receptacle or furnace, and the pipe is caused to turn on itself in such a manner that all of its cross section is completely introduced into the bath during the course of rotation, characterised in that the pipe is placed within the furnace such that it acquires, under the effect of gravity, a position in which its external convex surface is tangential to a concave surface of the furnace, and a reciprocating rotational movement around its axis is imparted to the furance, whereby the pipe is caused to turn on itself while rolling in contact with the concave surface.

Preferably, a support is positioned beneath the lower surfaces of the pipe after it leaves the rolling surface of a feed ramp which is outside the furnace, and the pipe is then transferred on the support directly onto the concave surface of the furnace. Similarly, after treatment, a support is positioned beneath the lower surfaces of the pipe which is resting on the concave surface of the furnace and the pipe is then transferred on the support directly onto the rolling surface of an evacuation ramp which is outside the furnace and which, if necessary, is combined with the supply ramp.

The invention also provides an installation including a receptacle or furnace, of general cylindrical shape, containing a metal treatment bath and means for heating this bath, rollers with a horizontal axis which support the furnace, handling means for introducing and removing pipes through an opening in the furnace, and means for imparting an angular movement to the furnace around its horizontal axis, characterised in that, on the internal wall of the furnace, rolling surfaces are provided which are directed laterally and are of concave profile, in order to support a pipe resting thereon.

By means of this arrangement, the immersion of the pipe into the bath over the whole of its cross section is ensured by very simple means, without risking ovalisation since the pipe is caused to rotate on itself by rolling within the furnace.

Preferably, the handling means comprise means for retaining and transferring a pipe, the retaining and transferring means being articulated on the external wall of the furnace in such a manner that they can penetrate within the furnace in order to place a pipe to be treated on rolling surfaces of the furnace and can be moved out of the furnace in order to remove a treated pipe from the bath.

By means of this particular arrangement, the means for handling each pipe are reduced to their most simple form.

Embodiments of the invention will now be described, by way of example, with reference to the accompanying drawings, in which.

Figure 2:
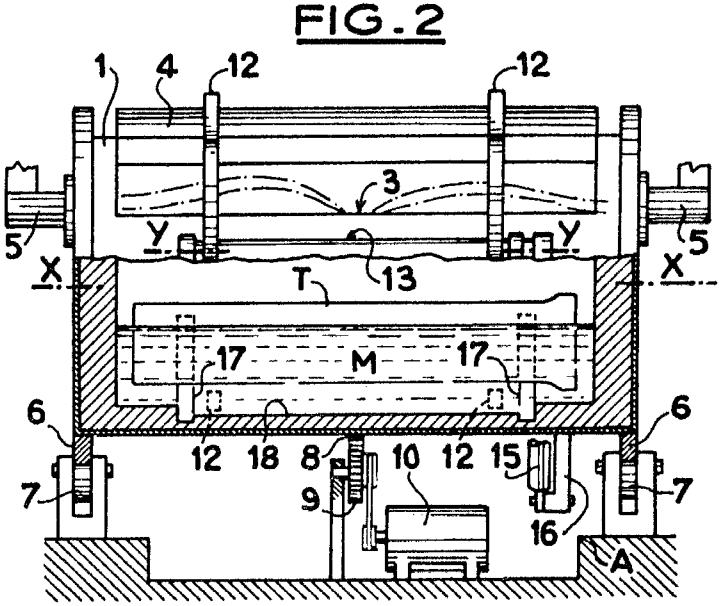
FIG. 2 is a diagrammatic view of the annealing furnace, in elevation, partly from the outside and partly in cross section.
Figure 3:
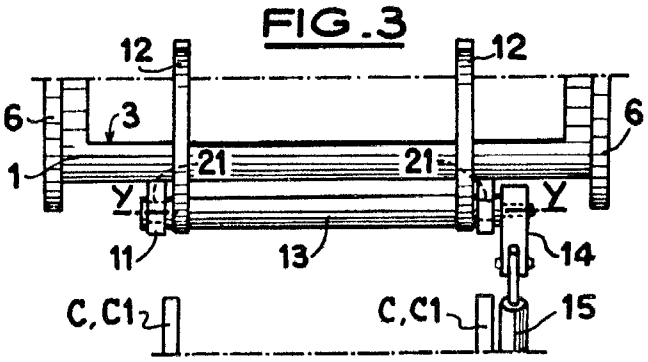
FIG. 3 is a partial view of the means for gripping and transferring the pipe, which are pivoted on the external wall of the annealing furnace.

The cylindrical annealing furnace 1, with an axis XX, includes at either end two annular bearing surfaces 6, each of which rests on two rotating rollers 7, which are arranged symmetrically in relation to the vertical plane P which passes through the axis XX and are supported by an infra-structure A which is anchored to the ground. The sheet steel wall of the furnace, which is lined on the inside with refractory bricks 2, has a longitudinal opening 3 for introducing and removing each pipe T, which a sliding cover 4 can close.

Figure 1:
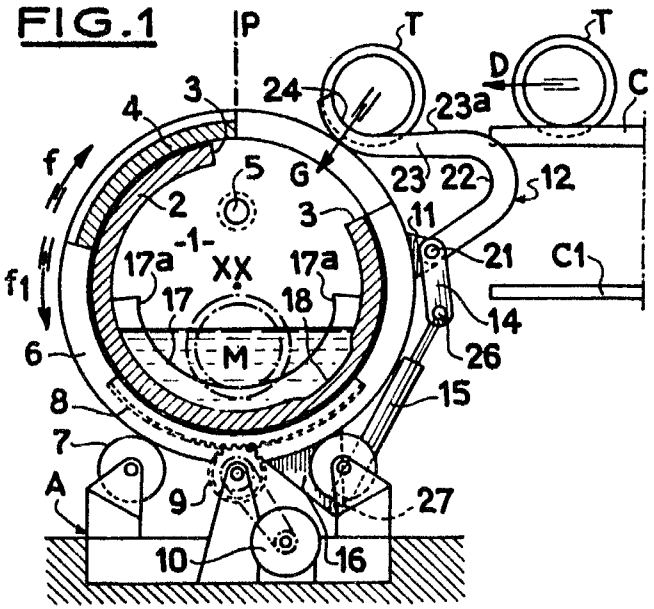
FIG. 1 is a diagrammatic view, in cross section, of an installation according to the invention, illustrating a lateral cross section of an annealing furnace whilst a pipe to be treated is being introduced.

Two burners 5, whose nozzles are directed axially and are situated above the axis XX and in the plane P when the furnace is in the centered position of FIG. 1, are fixed, in a manner already known, by collars on the end faces of the furnace 1. These burners 5 produce long flames above the level of the bath of metal M. As a variant, the burners 5 can be replaced by any other equivalent means of heating, for example, by induction heating as in the above-mentioned patent application 77/06076.

For the driving of the rotating furnace, a drive pinion 9 is provided the axis of which is parallel to the axis XX and which is supported by the infra-structure A. This engages with a toothed rack 8 which is supported by the external face of the steel plate wall of the annealing furnce, for example, towards the middle of the furnace, but which may be in the vicinity of an annular bearing surface 6. This toothed rack forms an arc which is greater than the maximum amplitude of rotation of the furnace, which is calculated in such a manner as to correspond to at least a half turn of rotation of the pipe T in the bath M. This amplitude is, for example, 90°.

The pinion 9 is driven, via a transmission, by a reduction gear unit 10 fixed inside the infra-structure A, for example, at the bottom of a pit. It is able to cause the furnace 1 to rotate in both directions of rotation f and $f_1$ and, in particular, to impart to it an alternating rotation which gives rise to angular movements of equal amplitude, either side of the vertical plane P starting from the centered position of FIG. 1.

Instead of the means 8, 9 and 10 for causing the furnace 1 to oscillate, it is possible to use equivalent means, for example, two mechanisms, each of which corresponds to a direction of rotation, consisting of a chain, one end of which is attached to the wall of the furnace and the other end to the stem of a traction actuator, and which is wound on a reversing pinion.

For the handling of the pipe T, two gripping and transfer arms 12, which are identical and parallel, are each pivoted, at one end about a shaft 21 which is parallel to the axis XX and is mounted on a lug or flange 11 which is fixed on the external face of the furnace wall in the vicinity of the lower edge of the opening 3. The arms 12 are rotated together around the axis YY (FIG. 2) which is established by the shafts 21 by a cross piece 13, which is, for example, coaxial with the two pivot shafts 21. Each arm 12 has a double curved shape, or proboscis shape, established on the internal face of the arm, in a position adjacent to the shafts 21, by a deep concave loop 22, and as a continuation of a central portion or branch 23 opposite the shafts 21 by a shallow external concavity 24, which forms an end cradle in which a pipe can be held. The end cradle can penetrate within the furnace through the opening 3 (arrow G) when the arms 12 pivot anti-clockwise and when the loops 22 overlap the part of the wall of the furnace which is adjacent to the lower edge of the opening 3.

There can be three or four arms 12, or more, depending on the length of the pipe T to be carried.

One of the arms 12, at right angles to the shaft 21, is integral with one of the ends of an actuating arm 14, which is short and rectilinear. The arm extends from the other end of the shaft in relation to the arm 12 and is articulated at 26 to the end of the stem of the actuator 15. The actuator housing is jointed at 27 on a supporting flange or lug 16 which is attached to the external face of the wall of the furnace 1.

Lateral rails 17 which define a part-circular rolling surface which is concentric to the wall of the furnace, are embedded in the refractory brickwork 2 of the furnace for the purpose of receiving pipes T inside the furnace and within the bath M. The rails 17, which, in the centred position shown in FIG. 1, extend symmetrically either side of the plane P, are raised at their end at 17*a* to form stops for the pipe T which rolls on the rails 17. The arc of the rail 17 corresponds to the maximum amplitude of rotation of the annealing furnace 1 and determines the diameter of pipe which can be treated within the furnace. For large diameters the amplitude of the arc must increase in order to make it possible for the pipes to make at least a half turn in each direction of rotation of the furnace. For a pipe of small diameter the amplitude and the arc of the rails 17 can, on the other hand, be reduced.

In order to make it possible for the cradles 24, when loaded with a pipe, to move below the level of the rails 17 at the end of a return travel of the arms 12, in order to place the pipe on the rails 17, a hollow 18 is provided in the refractory lining 2, between the rails 17, in order to receive the end part of the arms 12.

By means of this installation the annealing of a cast iron pipe T, with spheroidal or lamellar graphite, or a steel tube T is carried out, in different phases, in the following manner.

It is assumed that the furnace 1 is stopped. Since its cover 4 is retracted, its opening 3 is directed towards the upper rolling ramp C. The rectilinear outside edge 23*a* of the branch 23 of the arms 12 is in the extension of the ramp C (FIG. 1), in a position in which the end cradles 24 form stops for a pipe T. The actuator 16 immobilises them in this position for receiving a pipe T. The furnace 1 contains a metal bath M which is kept molten by the burners 5, whose level is clearly lower than that of the lower edge of the opening 3 which must be lowered even further during the course of a further rotation of the furnace.

A pipe T rolls on the ramp C in the entry direction D, it engages on the arms 12 until it comes to a stop against the cradles 24 of the arms 12 which hold it. The actuator 15 then causes the arms 12 to tilt in such a manner that the pipe T is brought nearer to the opening 3 of the furnace and introduced inside.

Figures 4, 5, 6, 7, 8:
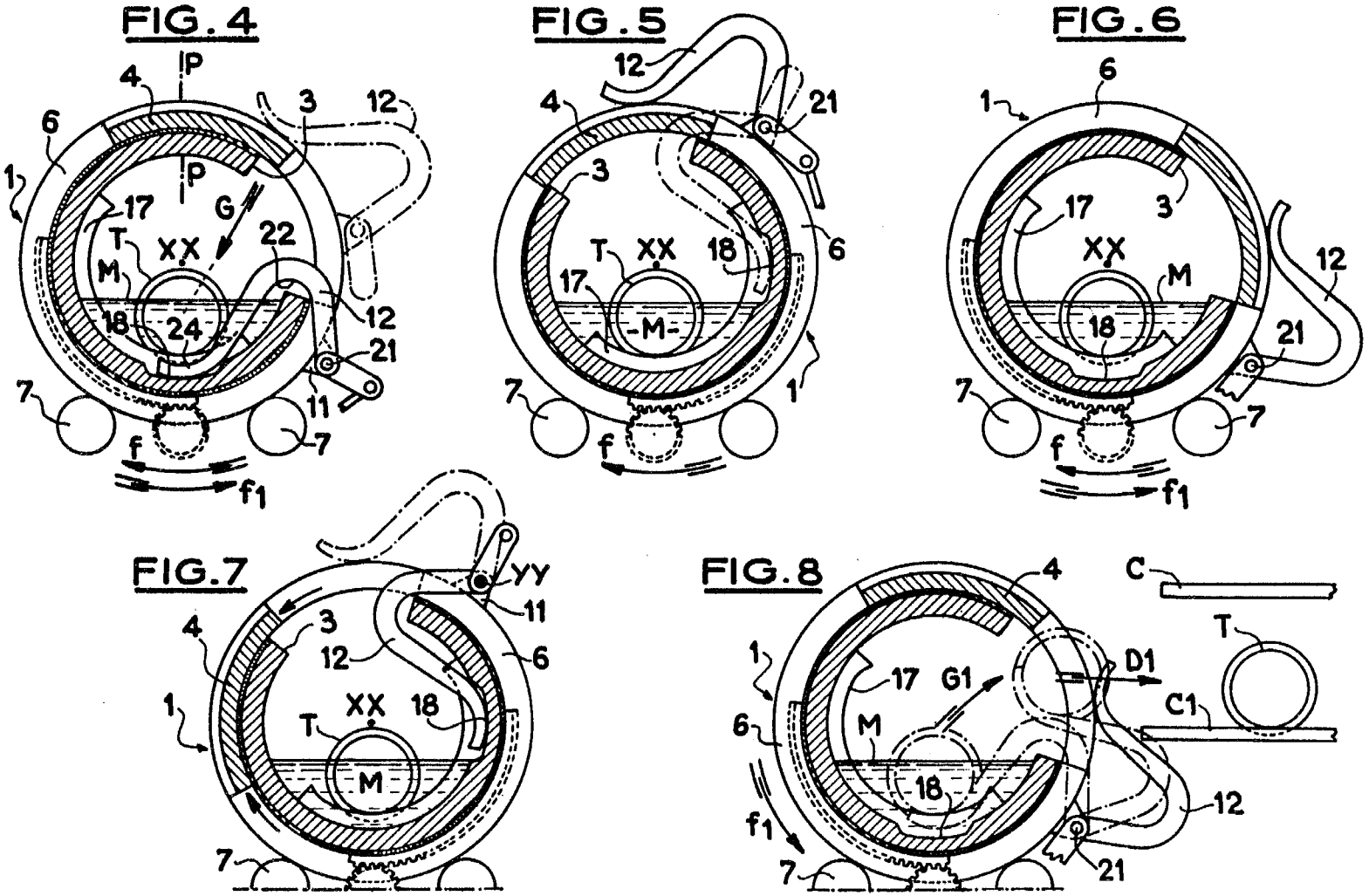
FIGS. 4 to 8 are diagrammatic views of the successive phases of handling and treatment of a pipe inside and outside the annealing furnace, with alternating rotating or oscillating movements of the annealing furnace.

To make this introduction easier, the reduction gear unit 10 is set in operation so that simultaneously with the rocking of the arms 12, the furnace 1, which is carried by its annular bearing surfaces 6 on the rollers 7, turns in the direction of the arrow f. The end of the internal rails 17, which is adjacent to the lower edge of the opening 3, is thus lowered, the purpose of this rotation of the furnace, coordinated with the rocking of the arms 12, being basically to preserve at every moment a perfectly balanced position of the pipe T on the arms 12, avoiding too sharp a slope of the branch 23 of the arms 12 from risking causing the pipe to roll by gravity above the end of the cradles 24 and to be caused to plunge suddenly into the annealing furnace. The pipe T thus approaches the rails 17 following a trajectory of oblique direction G (FIGS. 1 and 4).

Before the furnace 1 has reached the limit of its rotation in the direction f and before the lower edge of the aperture 3 has reached its lowest position, the arms 12, by means of rocking, assume a more tilted position whilst still keeping the pipe T firmly supported. The pipe is satisfactorily retained because of the concave shape of the cradles. The pipe T begins its immersion in the bath M.

At the end of the angular travel of the furnace 1, when the hollow 18 is more or less centred in relation to the plane P, the arms 12 have reached their furthest tilting position around the shafts 21. At this moment the cradles 24 are retracted below the rails 17, into the hollow 18, in such a manner that the pipe T is placed gently on the rails 17 (FIG. 4), in a gravitationally balanced position for which its axis is in the plane P. In this example, the pipe T is not totally immersed or submerged, one part of its cross section remaining outside the bath M, but if its diameter was sufficiently small, it would be completely immersed.

After the pipe T has been deposited on the rails 17 the direction of rotation of the reduction gear unit 10 is reversed, and hence that of the furnace 1, which then turns integrally with the arms 12 which are completely returned, in the direction $f_1$ in such a manner that the pipe T, which remains practically centred in the plane P, rolls on the rails 17 and is placed outside the reach of the cradles 24 of the arms 12. It is then possible for the arms 12 to be removed from the furnace by a tilting movement being imparted to them in clockwise direction, by means of the actuator 15, which saves them from thermal stresses of long duration and makes it possible to close the cover 4 (FIG. 5).

The heat treatment of the pipe T is carried out with the cover 4 closed, under the influence of a reciprocal movement of rotation of the furnace, that is, angular oscillations in the two directions f and $f_1$, with the arms 12 outside the furnace. During each travel in the direction f or $f_1$ the pipe T remains practically centered in the plane P, but it turns on itself as it rolls on the rails 17 in bath M in which its annealing is carried out in this manner. At each end of travel of the furnace the pipe comes to a stop on the turned up end part 17*a* of the rails 17.

During the process of the oscillations, the pipe T rolls progressively immersing the whole of its cross section in the bath M. If, as in this example, it is never completely immersed owing to its diameter being greater than the greatest depths of the bath, the amplitude of the arcs of the circle formed by the rails 17 is sufficient to make it possible for the pipe T to accomplish a complete revolution on rolling in order to soak the whole of its circular cross section. Whatever the diameter of the tube T may be, its rolling action on the rails 17 avoids its becoming oval.

When the annealing time has elapsed, without stopping the oscillations of the furnace, the cover 4 is open in order to free the opening 3 completely, and, at a moment at which the end of the rails 17 opposite the opening 3 is under the pipe T, the actuator 15 is activated again in such a manner as to cause the arms 12 which follow the direction G to tilt in the furnace, the cradles 24 resuming their retracted position in the hollow 18 under the rails 17. (FIG. 7).

At the end of the next oscillation, in the direction f of the furnace, the cradles 24 come underneath the pipe T and the furnace, whose position is then such that the lower edge of the opening 3 is at its nearest position to the lower rolling ramp $C_1$, is stopped. The arms 12 are raised by means of the actuator 15, following the oblique trajectory $G_1$ (FIG. 8), and they raise the pipe T. The tilting movement of the arms 12 can then be stopped, at the moment at which the linear edge 23*a* of the branch 23 of the arms 12, which is situated in the extension of the lower rolling ramp $C_1$, is sufficiently tilted for the pipe T to be able to roll onto this edge and in this manner to reach the evacuation ramp $C_1$, possibly aided by the thrust exerted by the concavity formed by the cradles 24.

Figure 9:
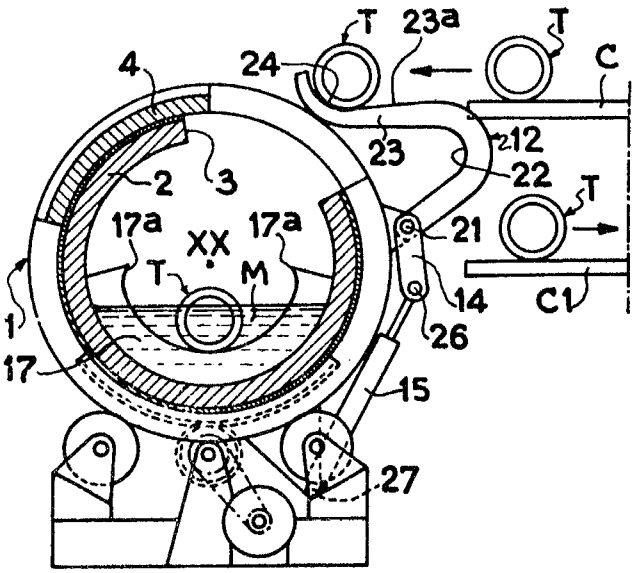

The arms 12 can be of a slightly different shape from that of FIGS. 1 and 9, provided that they have a loop 22 in order to avoid the wall of the furnace and an end cradle.

Figure 11:
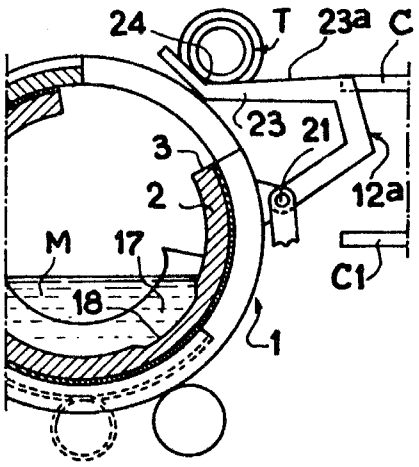
FIGS. 11 to 13 are partial diagrammatic views of variants of means for gripping and transferring the pipe.

In FIG. 11 the arm 12*a* has elbows with obtuse angles instead of having continuous curves. The end cradle 24 forms an obtuse angle or a flared V.

Figure 12:
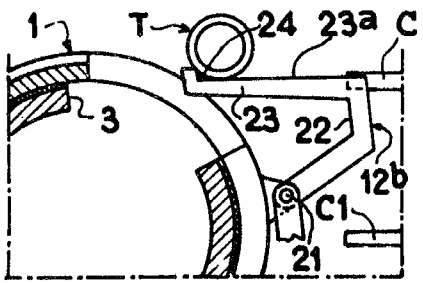

In the variant of the arms 12*b* of FIG. 12 the end cradle constitutes a simple elbow of about 90°, which projects slightly in relation to the linear branch 23. This form of execution is suitable for pipes T of small diameter.

Figure 13:
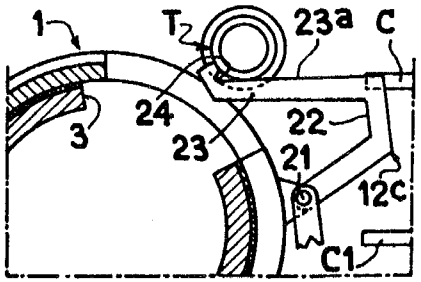

In FIG. 13, the variant of the arm 12*c* includes a turned up end elbow.

It is possible to provide several actuators 15, which are obviously synchronized, for the control of the arms 12, whose number, as has already been indicated, can be greater than two.

Figure 10:
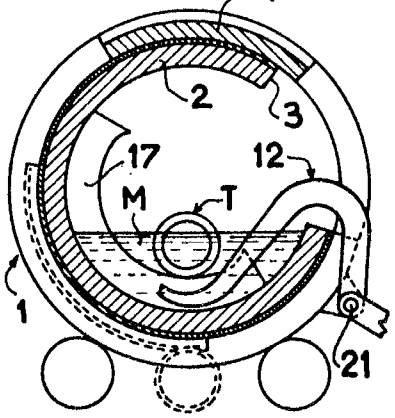
FIGS. 9 and 10 are diagrammatic views similar to FIGS. 1 and 4, of two phases of handling a pipe in an annealing furnace equipped with a variant of the internal rolling surfaces for support of the pipe.

According to the variant of FIGS. 9 and 10, the hollow 18 is eliminated and the rails 17 have a projecting height above the refractory wall 2 which is greater than the thickness of the cradled end 24 of the gripping arms and support arms 12 of a pipe.

Owing to the coordination, which is obtained by known means, of the simultaneous movements of rotation of the furnace 1 and tilting of the arms 12, and owing to the tilting of the trajectories G and $G_1$, the pipe T is supported by the cradles 24 of the arms 12 in a position of perfect equilibrium at the moment that it is introduced (FIG. 4), and removed (FIG. 8) without the risk of escaping from the arms 12 and falling suddenly into the bath M. This same coordination of the two movements of rotation around the axis XX and the axis YY, which rotates about the axis XX, makes it possible to place the pipe T gently on the rails 17, at the bottom of the furnace, in a position which is balanced and stable (FIGS. 4 and 10).

Owing to the hollow 18 which is situated axially to the right of one of the ends of the rails 17, the cradle ends of the arms 12 can place a pipe T on the rails 17 and take it up again. The hollow 18 makes it possible to limit the projection of the rails 17 above the wall of the refractory lining 2 and consequently gives the benefit of a greater useful volume in the furnace 1.

On the other hand, the variant of FIGS. 9 and 10 in which the hollow 18 is eliminated and replaced by a greater height of the rails 17, has the advantage of facilitating the making of the refractory lining wall 2 but has the drawback of reducing the capacity of the content of the furnace 1.

By means of the rails 17 and the rotations of the furnace 1 in the opposite directions f and $f_1$, the pipe T rolling on the rails 17 turns on itself 180° in both directions, thus achieving a complete revolution, and avoids becoming oval whilst soaking the whole of its lateral cross section during the course of its rotation, even if its diameter is greater than the depth of the bath. Because of the shape with multiple curves or elbows of the arms 12, 12*a*, 12*b*, and their hinging onto the furnace 1 itself, and their pivoting assembly, each pipe T is easily transferred in both direction D - G, $D_1$-$G_1$ between the supply and removal ramps C, $C_1$ and the rails 17 of the furnace, in a stable and balanced position, without risk of escape and falling, hence, following the shortest trajectory, and with the greatest safety. The possibility, afforded by the rotation of the furnace 1, of bringing the opening 3 close to the rolling ramps C and $C_1$ also contributes to this advantage.

Finally, because of the tilting of the arms 12 around shafts 21 carried by lugs 11 fixed to the furnace, it is possible to hold the arms 12 outside the furnace during the heat treatment and thus to reduce their wear, and it is possible to close the cover of the furnace, and hence to improve its heat insulation.

Although this has not been shown, the furnace 1 can be provided with at least one lateral opening for introducing a suitable powder into the metal bath M with a view to preventing the aluminium from adhering to the pipe. This powder can be carbon black. It can be projected onto the inside and outside of the pipe T and inside the furnace 1.

Figure 14:
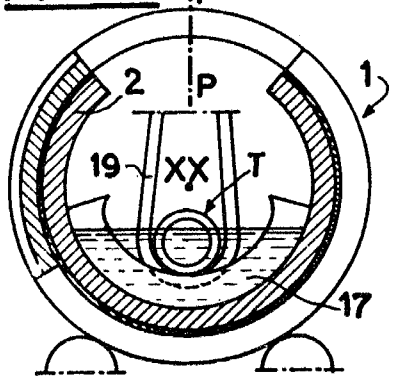
FIG. 14 is a diagrammatic view which is similar to FIG. 4 of a variant of the annealing furnace according to the invention, equipped only with internal rolling surfaces for support of the pipe.

According to FIG. 14, the external means of gripping and support of each pipe T does not have to be made integral with the furnace 1. In this variant the furnace 1 remains rotating and oscillating and consists on the inside of rails 17 for rolling of the pipe T. Each pipe T is simply placed on the rails 17 and taken up from these rails 17 after heat treatment, by means of hooks 19 which pass under the lower surface of the pipe T. These hooks 19 with curved ends are suspended from a lifting apparatus, for example, symmetrically to the vertical plane P which passes through the axis XX of rotation of the furnace 1.

Of course, the system for causing rotation of the furnace 1 and the system for tilting the arms 12 described above can again be replaced by equivalent systems.

As a variant, one could have only one rolling ramp C, situated in the upper position, from which each pipe is introduced into the furnace, this ramp remaining free until the pipe is removed from the furnace in order to bring it back onto the same ramp with a view to its removal. In this case the rotation of the furnace is carried out in one direction, at the same time that the rocking of the arms 12, in order to introduce the pipe into the furnace is carried out in the opposite direction, in a symmetrical manner, to remove the pipe from the furnace.

We claim:

1. An installation including a furnace of a generally cylindrical shape, containing a treatment bath of molten metal, means for heating the treatment bath, rollers for rotatably supporting the furnace wherein the furnace is rotatable around a longitudinal axis of said furnace, handling means for introducing and removing pipes through an opening in the furnace, and means for imparting an angular movement to the furnace around its longitudinal axis, characterised in that, on the internal wall of the furnace, rolling surfaces are provided which are directed laterally and are of concave profile, for supporting a pipe resting thereon, and wherein the handling means comprise means for retaining and transferring a pipe, the retaining and transferring means being articulated on an external wall of the furnace in such a manner that they can penetrate within the furnace in order to place a pipe to be treated on rolling surfaces of the furnace and can be moved out of the furnace in order to remove a treated pipe from the bath.

2. An installation according to claim 1, characterized in that the rolling surfaces consist of rails in the form of an arc of a circle whose center is on the axis of the furnace.

3. An installation according to claim 2, characterised in that the rails are turned up at their ends to form stops with regard to the pipe.

4. An installation according to claim 1, characterised in that the retaining and transferring means comprise at least two arms, each of which is pivoted at one of its ends to the external face of the wall of the furnace, each arm being pivoted about an axis which is parallel to the axis of the furnace and having a curved configuration defined by a loop one of whose branches is adjacent to the pivot axis, an end part in the form of a cradle, and a central portion which is a continuation of the end part and is connected to the loop, whereby a pipe can be retained in the end part and moved into the furnace through an opening to a final position in which the loop describes a curve around the part of the wall of the furnace which is adjacent to the corresponding edge of the opening and the pipe is placed on the rolling surfaces.

5. An installation according to claim 4, characterised in that the rolling surfaces form, in relation to the refractory lining of the furnace, a projection whose dimension is greater than the thickness of the cradle defining end part of the arms.

6. An installation according to claim 4, characterised in that the refractory lining of the furnace consists of at least one recess whose depth is such that the cradle end of the arms, engaged in this hollow, is retractable to a level lower than the rolling surfaces.

7. An installation according to claim 4, characterised in that, in order to control the pivoting movement of the arms, at least one actuator is provided whose moving element drives an actuating arm integral with the arms, the actuating arm being situated on the opposite side of the pivot axis to the arms.

8. An installation according to claim 4, characterised in that the loop and the cradle defining end part are formed as concave curves in the arms.

9. An installation according to claim 4, characterised in that the loop and the cradle defining end part are formed as elbows of the arms.

10. An installation according to claim 2, characterised in that the opening of the furnace can be closed by a movable cover when the arms are outside the furnace.

11. An installation according to claim 4, characterised in that the edges of the central portions of the arms, which are continuations of the cradle defining end parts, are approximately linear in such a manner that they can be situated in the extension of a supply ramp which is outside the furnace, on which the pipe can roll before being retained on the cradle.

12. An installation according to claim 11, characterised by an evacuation ramp which is situated outside the furnace at a level lower than that of the feed ramp and on which a pipe can be placed by the arms after its treatment.

* * * * *